US005554067A

United States Patent [19]

Lecerf et al.

[11] Patent Number: 5,554,067

[45] Date of Patent: Sep. 10, 1996

[54] FRAME HOLDER FOR PRESCRIPTION GLASSES

[75] Inventors: Michel J. M. Lecerf; Raynald G. M. Longuet, both of Amfreville la Campagne, France

[73] Assignee: Buchmann Optical Engineering, Ieper, Belgium

[21] Appl. No.: 447,878

[22] Filed: May 23, 1995

[51] Int. Cl.[6] ..... B24B 41/06

[52] U.S. Cl. ..... 457/384; 451/365; 451/390; 451/364; 269/296; 269/902

[58] Field of Search ..... 451/365, 384, 451/390; 269/296, 297, 298, 299, 902

[56] References Cited

U.S. PATENT DOCUMENTS

| | | | |
|---|---|---|---|
| 4,049,054 | 9/1977 | Godot | 269/156 |
| 5,137,263 | 8/1992 | Savoie et al. | 269/266 |
| 5,228,242 | 7/1993 | Matsuyama | 451/6 |
| 5,377,456 | 1/1995 | Dixon | 451/390 |
| 5,501,017 | 3/1996 | Suzuki | 33/200 |

*Primary Examiner*—D. S. Meislin
*Assistant Examiner*—George Nguyen
*Attorney, Agent, or Firm*—Harrison & Egbert

[57] ABSTRACT

The frame holder for prescription glasses (24) of the type featuring two jaws mounted in such manner that they slide in relation to each other so that they can move toward or away from each other, and also featuring a device (22) to center the frame (24) between the jaws (12) so as to hold said frame (24) in a reference plane (P), characterized by the fact that it features a device (30) to support frame (24) approximately in the reference plane (P) before the frame (24) is clamped inside the jaws (12).

6 Claims, 2 Drawing Sheets

FIG. 3
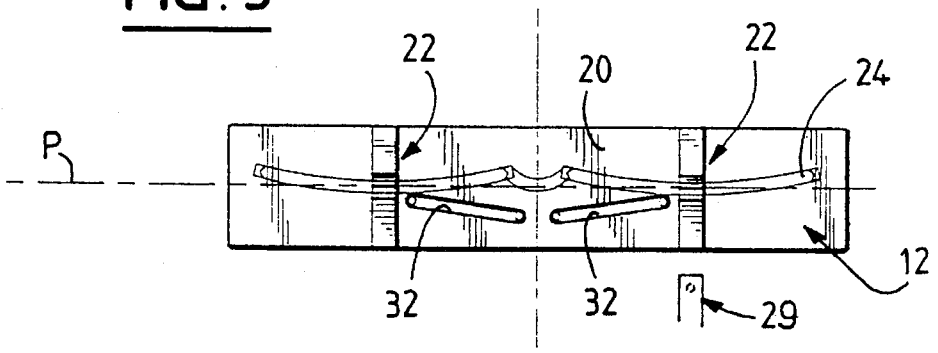
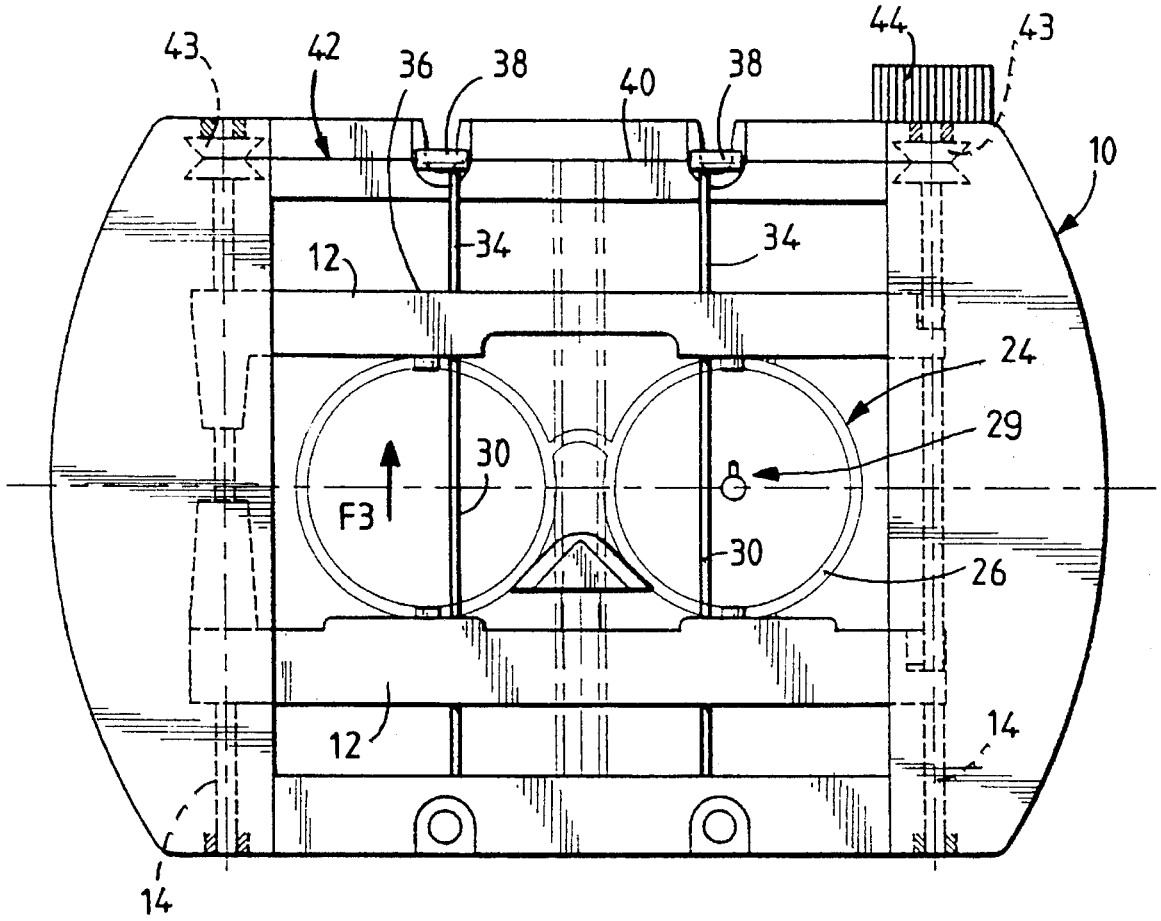
FIG. 2

FRAME HOLDER FOR PRESCRIPTION GLASSES

This invention concerns a frame holder for prescription glasses.

The invention concerns more specifically a frame holder which is part of an apparatus designed to automatically pick up the shape and/or profile of the inside contour of at least one of the rims of the glass frame.

BACKGROUND ART

Document FR-A-2.630.030 describes and represents a frame holder for prescription glasses of the type featuring two jaws mounted in such manner that they slide in relation to each other so that they can move toward or away from each other, and also featuring a device to center the frame between the jaws so as to hold said frame in a reference plane.

French patent application No. 91 09595 describes and represents an apparatus designed to automatically pick up the shape and/or profile of the inside contour of a glass frame rim using a frame holder with sliding jaws.

The execution of pairs of glasses according to an automated process requires indeed to be able to carry out accurately and automatically the edging of ophthalmic lenses with which glass frames are to be fitted, using a grinding machine in which the cutting operations are controlled by computerized data from the apparatus picking up the shape of the frame.

In such apparatus designed to pick up the shape of the frame, it is necessary to hold the glass frame in a highly precise and reliable manner during the plotting operations.

Under the known design of the above-mentioned frame holder, the user must show extreme skill to hold the frame basically in the reference plane while the sliding jaws are moved toward each other.

This applies for example to the device described in DE-A-41 26 313 by NIDECK CO. LTD. This prior document describes a cutting and polishing machine for ophthalmic lenses, featuring a device to determine the three-dimensional measurements of a glass frame so that these measurements, especially the measurement of the spacing of the geometric centers of the lenses, can be used to cut the lenses based on the dimensions of the frame of the glasses.

The glass frame is held through moving elements provided with holding pins and clamping elements so that the holding of the frame under this prior device involves a great number of moving parts and is highly complex.

Furthermore, as the elements extend toward the inside of the frame in the direction of the location of the lenses (FIG. 3), these elements are likely to hinder any possible plotting of the inside contour of a glass frame rim so that this device is not suitable for that measurement.

In addition, the device under the prior document does not feature any means to support the frame before its being clamped by the jaws.

The jaws must be moved close to the frame, which requires holding the frame by hand until it is fully gripped by the clamps on each side of the frame.

Any mishandling can either cause the frame to fall if it is improperly held, or to be inaccurately positioned in the frame holder, especially with respect to the geometrical reference plane.

Under various designs of apparatus intended to pick up the shape of the rim of a glass frame held between closed jaws, it is also necessary to run along the inside of the frame rim a sensor or tracer, which requires during the pick-up phase to completely free the inside of the frame rim.

The purpose of this invention is to propose a new design of frame holder permitting to eliminate the above-mentioned disadvantages.

SUMMARY OF THE INVENTION

The present invention is a frame holder of the type described and represented in document FR-A2,630,030, characterized by the fact that it features means to support the frame, approximately in the reference plane, prior to the clamping of the frame with the jaws.

According to other features of the invention:

- the support consists of at least two rods parallel to the sliding direction of the jaws, each one extending opposite a rim of the frame to serve as support to the frame;
- the support is mounted in a moving manner in relation to the jaws so that, after the jaws are closed, it can be retracted and permit to pick up the frame rim contours;
- each rod can move transversely, in a direction perpendicular to the jaw sliding direction, from an idle position under which it extends facing the associated frame rim to a transversely shifted, retracted position which frees the frame rim;
- the frame holder features a drive system for the mobile support to cause its movement;
- the ends of the rods are attached onto the opposite parallel strands of a cable making up a closed loop around two transversely spaced pulleys, with one end connected to a cable and rod driving component;
- each rod can slide in relation to the jaws inside opposite grooves facing each other in both jaws and extending in directions at an inclination in relation to the reference plane so that the rods are moved away from the reference plane whenever the rods are in retracted position;
- in the retracted position, the supporting rods are adjacent in a central position facing the bridge connecting the frame rims.

These and other objects and advantages of the present invention will become apparent from a reading of the attached specification and appended claims.

BRIEF DESCRIPTION OF THE DRAWINGS

FIG. 2 is a top view of the frame holder; and

FIG. 3 is a view of one of the jaws according to arrow F3 on FIG. 2

DETAILED DESCRIPTION OF THE INVENTION

Figure 1:
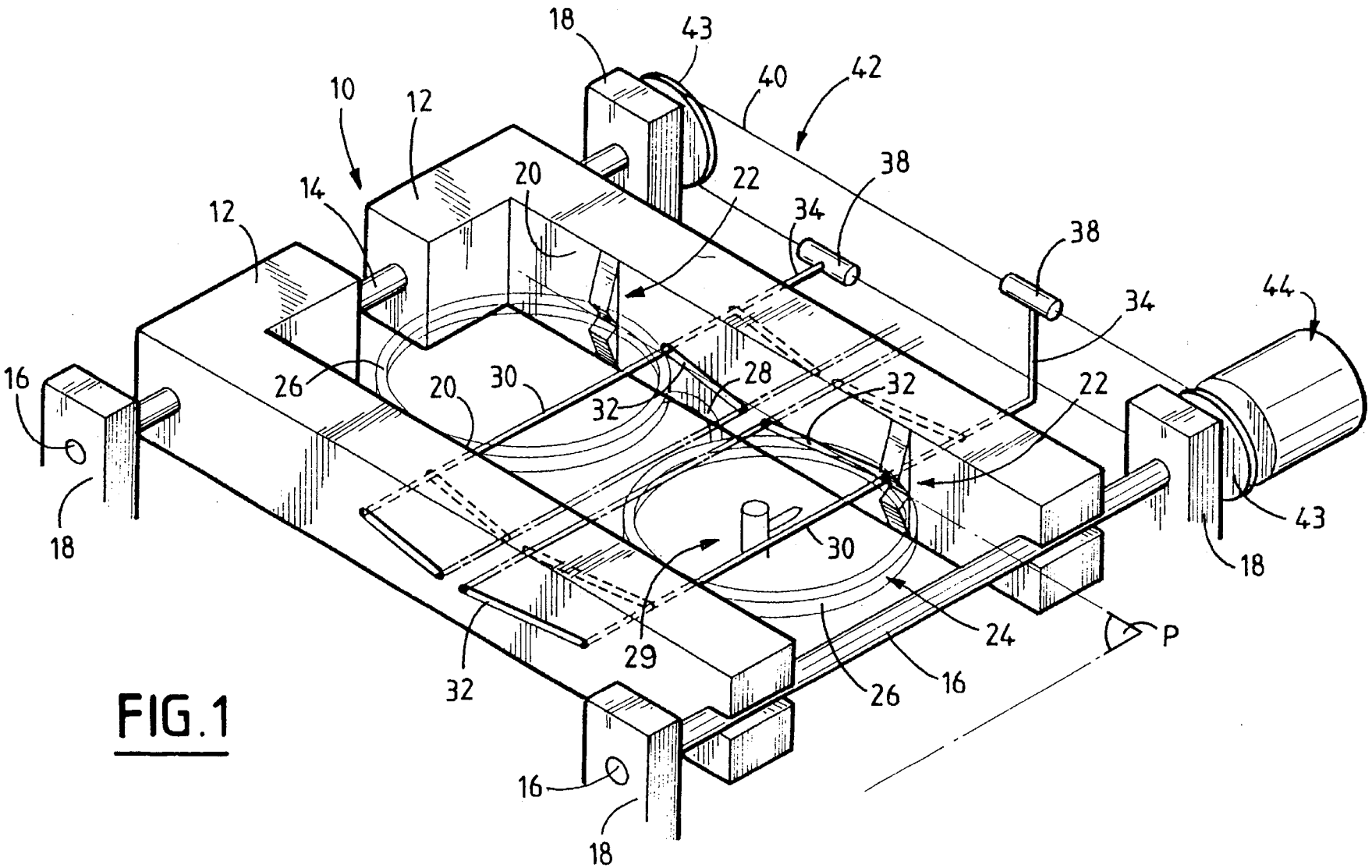
FIG. 1 is a schematic view in perspective of an embodiment of a frame holder in accordance with the invention specifications.

Under a known design, described in detail in document FR-A-2,630,030, frame holder 10 features two jaws or bars 12 which slide on guiding rods 14 whose free ends 16 are held by vertical supports 18.

Under the known design, jaws 12 are likely to slide simultaneously away or toward each other under the action of a drive system not represented on the figures.

Each internal face 20 facing both jaws 12 features a device 22 to center and hold in position between the jaws a glass frame 24.

A glass frame traditionally consists of two frame rims 26 connected in the central part of the frame 24 by a connecting bridge 28.

The centering device 22 is made of centering vees, all four of them located in the same geometric plane P parallel to the sliding direction of the jaws, and between which rims 26 of frame 24 are held when the jaws are in a closed position.

Vees 22 thus define a reference plane P for the positioning of frame 24 in frame holder 10 as indicated on FIG. 3.

On FIG. 1, a tracer 29 is also schematically represented, whose function, under a known design, is to pickup the profile and/or the internal contour of at least one frame rim 26 whenever frame 24 is in position between the closed jaws 12.

According to the invention, the frame holder 10 features an horizontal device supporting frame 24 before jaws 12 are closed.

Under the embodiment illustrated on the figures, the supporting device consists of two parallel rods 30 represented on the figures as a continuous line in their supporting position and as a dotted line in their retracted position.

Each rod 30 extends parallel to the sliding direction, and thus to guiding rods 14.

Each rod 30 is received close to its two opposite ends in a guiding groove 32 formed in each jaw 12.

As shown in FIGS. 1 and 2, grooves 32 are inclined in relation to reference plane P and the rods can move transversely inside said grooves 32 from their supporting position to their retracted position, in which case they are respectively located at the lower ends of grooves 32, looking at FIG. 3, and in a central position with respect to bridge 28.

The ends 34 of rods 30 protrude axially through grooves 32 past the outside face 36 of one of the jaws 12 to be attached through a proper device 38, each onto one of the parallel strands 40 of a drive cable 42 mounted in a loop on two pulleys 43 with parallel axis.

One of the pulleys 43, to the right looking at FIGS. 1 and 2, is equipped with a button 44 to drive cable 42 and thus simultaneously drive support rods 30.

Under another embodiment, not represented in the FIGS, button 44 can be replaced by an electric drive motor featuring a device to limit its angular travel to two positions corresponding to the two positions of support rods 30.

The frame holder 10 just described can be used as follows:

Whenever the jaws are apart from each other, and rods 30 are in their supporting position as represented in a continuous line on the figures, the user lays the frame 24 on rods 30 used as support for rims 30 of frame 24. The presence of the two rods 30 is a new beneficial feature allowing for an automatic positioning of the frame, i.e., without having to hold the frame by hand.

The user then starts clamping the frame held in the reference plane P by causing a simultaneous bringing together of jaws 12 which then clamp rims 26 of frame 24 in vees 22, whose use is known by itself.

Upon completion of this clamping operation, the user causes through button 44 a transverse retraction of rods 30 which are then simultaneously led through cable 42 into the central retracted position represented in a dotted line.

In this contour sensing position of rims 26, the latter are fully freed to allow for the plotting operations using tracer 28.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

We claim:

1. Frame holder (10) for prescription glasses (24) of the type featuring two jaws (12) mounted in such manner that they slide in relation to each other so that they can move toward or away from each other, and also featuring a device (22) to center the frame (24) between the jaws (12) so as to hold said frame (24) in a reference plane (P); said frame holder (10) for prescription glasses featuring also a device (30) to support frame (24) inside jaws (12), said device (30) supporting frame (24) features at least two rods (30) parallel to the sliding direction of the jaws (12), each one (30) extending opposite a rim (26) of the frame (24) to serve as support to the frame (24) before its being clamped by the jaws, said rods (30) being mounted in a moving manner in relation to the jaws (12) so that, after the jaws (12) are closed, it can be retracted so as to permit to pick up the contours of the frame (24) rims (26).

2. Frame holder according to claim 1, wherein each rod (30) can move transversely, in a direction perpendicular to the jaw (12) sliding direction, from an idle position under which it extends facing the associated frame rim (26) to a transversely shifted, retracted position which frees the frame (24) rim (26).

3. Frame holder according to claim 1 comprising a drive system (42) for the mobile support (38) to cause its movement.

4. Frame holder according to claim 3 wherein the ends (34) of the rods (30) are attached onto the opposite parallel strands (40) of a cable (42) making up a closed loop around two transversely spaced pulleys (43), with one end connected to a cable (42) and rod (30) driving component (44).

5. Frame holder according to claim 2 wherein each rod (30) can slide in relation to the jaws (12) inside opposite grooves (32) facing each other in both jaws (12) and extending in directions at an inclination in relation to the reference plane (P) whenever the rods (30) are in a retracted position.

6. Frame holder according to claim 2 wherein the supporting rods (30) when in the retracted position are adjacent in a central position facing the bridge (28) connecting the frame (24) rims (26).

* * * * *